US006296338B1

(12) United States Patent
Stijns

(10) Patent No.: US 6,296,338 B1
(45) Date of Patent: Oct. 2, 2001

(54) TELESCOPIC BAIL HAVING CONTROLLABLE POSITIONING

(75) Inventor: Andreas Petronella Maria Stijns, Bunde (NL)

(73) Assignee: Thomas Regout B.V., Maastricht (NL)

( * ) Notice: Subject to any disclaimer, the term of this patent is extended or adjusted under 35 U.S.C. 154(b) by 0 days.

(21) Appl. No.: 09/398,701

(22) Filed: Sep. 20, 1999

(30) Foreign Application Priority Data

Sep. 21, 1998 (NL) ..... 1010136

(51) Int. Cl.[7] ..... A47B 88/16

(52) U.S. Cl. ..... 312/333; 312/334.11; 312/334.46

(58) Field of Search ..... 312/333, 334.44, 312/334.45, 334.46, 334.47, 334.8, 334.11, 334.17, 334.38, 334.1, 330.1, 334.7; 384/18, 21

(56) References Cited

U.S. PATENT DOCUMENTS

| | | | | |
|---|---|---|---|---|
| 2,277,702 | * | 3/1942 | Kennedy | 312/334.46 X |
| 3,650,578 | * | 3/1972 | Del Vecchio et al. | 312/334.46 X |
| 4,333,690 | * | 6/1982 | Keefe et al. . | |
| 4,749,242 | * | 6/1988 | Rechberg | 312/334.11 X |
| 4,872,734 | * | 10/1989 | Rechberg | 312/333 |
| 4,993,847 | * | 2/1991 | Hobbs | 312/334.46 X |
| 5,033,805 | * | 7/1991 | Hobbs | 312/333 X |
| 5,551,775 | | 9/1996 | Parvin | 312/334.11 |
| 5,757,109 | | 5/1998 | Parvin | 312/334.11 |
| 5,871,265 | * | 2/1999 | Stewart et al. | 312/333 X |

FOREIGN PATENT DOCUMENTS 476 745 A1 3/1992 (EP) .

* cited by examiner

*Primary Examiner*—Peter M. Cuomo
*Assistant Examiner*—James O. Hansen
(74) *Attorney, Agent, or Firm*—Weingarten, Schurgin, Gagnebin & Hayes LLP

(57) ABSTRACT

A telescopic rail includes a first section and at least a second section with intermediate bearings. The second section may be adjusted with respect to the first section in the longitudinal direction between a retracted and an extended position. On the first section, a blocking unit is provided for blocking the freedom of movement of the second section with respect to the first section at least in the extended position. The blocking unit includes a swivel body controllable by at least one operating part extending at least partially between the relevant sections. The swivel body is placed in a first position between the first and second sections and can be moved into a second blocking position by the operating part or parts. The swivel body may extend, by a blocking part thereof, at least partially through an opening into or behind an edge of the second section.

19 Claims, 6 Drawing Sheets

TELESCOPIC BAIL HAVING CONTROLLABLE POSITIONING

BACKGROUND OF THE INVENTION

The invention relates to a telescopic rail. A known telescopic rail from practice is, for instance, supplied by the firm Jonathan, Fullerton, USA.

The known telescopic rail comprises a first section having a substantially C-shaped cross section whose back is provided with a guide rail which, with the interposition of a ball cage, is bearing-mounted in a second section likewise having a substantially C-shaped cross section.

The first section can be slid relative to the second section in the longitudinal direction, between a retracted position and an extended position. Provided in the back of the first section is an opening, adjacent the end which trails in the extending direction. By means of an axis that extends at right angles to the back of the first section, a blocking means is provided, comprising lips extending through the opening, which blocking means is moved into a blocking position under the influence of gravity. Adjacent the end of the second section which end leads in extending direction, there is provided at least one projection which lies in the path of travel of the blocking means when they are in the blocking position. The blocking means can pass the blocking projection by moving slightly upwards. Thus, the blocking means can be retained behind the blocking projection, i.e. between the blocking projection and the end of the second section that leads in extended direction. When the first section is being retracted relative to the second section, the blocking means should be pulled up slightly, causing the blocking lip to be moved from the path of the blocking projection, after which it can be passed. The desired lifting movement can be manually effected, yet in this known telescopic rail, this is brought about by a third section of a likewise C-shaped cross section, which third section is movable within the C-shaped first section and lifts the blocking means from the blocking position when the third section is being slid into the first section, in the direction of the retracted position.

This known telescopic rail has as a drawback that the blocking means are relatively costly in manufacturing, while the positioning thereof is moreover laborious and costly. In addition, these blocking means have the drawback of producing relatively much noise, in particular during movement into and out of the blocking position. Further, these blocking means require relatively much building-in space, in particular building-in length. Also, these blocking means have the drawback of being located adjacent the end of the first section which trails in extending direction, as a consequence of which this section should be relatively long. After all, at least a portion thereof should, in the extended position, extend behind the ball cage. A further major drawback of this known telescopic rail is that it can only be used with the backs of the sections in a vertical plane, as the operation of the blocking means is based upon gravity.

SUMMARY OF THE INVENTION

The object of the invention is to provide a telescopic rail, in which the drawbacks of the known telescopic rail mentioned have been avoided, while the advantages thereof have been maintained. To that end, a telescopic rail according to one embodiment of the invention is characterized by the features as described in the following paragraphs.

In a telescopic rail according to the invention, the swivel body in a first position, wherein the first section can move freely with respect to the second section, is included between the first and the second section. Thus, the swivel body is in a simple manner prevented from being engaged in this position, also when the telescopic rail comprises only two sections. Through the use of the movement of the bearing means for controlling the swivel body from the first position into a second, blocking position, a positive control is obtained, independent of, for instance, the position of the telescopic rail. Hence, in contrast with the known telescopic rail, the blocking action does not depend on, for instance, gravity. As a result, the operation is always guaranteed. Moreover, the advantage thus achieved is that the swivel body can relatively easily be prevented from being audible in an unacceptable manner during use. Indeed, the swivel body is retained in the blocking position, thus preventing relative movement of the first section with respect to the second section, while in the first position, it is positively retained between the first and the second section. Further, a telescopic rail according to the invention has the advantage that the blocking means, in particular the swivel body and the opening or longitudinal edge cooperating therewith, are relatively simple and inexpensive to manufacture, which is economically and technically advantageous. Further, the desired swivel movement of a swivel body according to the invention can be obtained by means other than the bearing means, for instance by a lip, projection or the like extending from one of the sections, whereby for instance the maximally extended length can also be fixed in a position at which the bearing means are still located at a distance from the swivel body, while such embodiment can, for instance, also be suitable when bearing means are used that are static relative to one of the a sections. Also, other types of operating means may be provided for initiating at least the swivel movement of the swivel body from the blocking position.

In an advantageous embodiment, a telescopic rail according to the invention is characterized as follows.

Operating the swivel body by moving the bearing means thereagainst in the extended position effects in a particularly simple manner a positive control of the swivel movement of the swivel body. Moreover, such embodiment offers the advantage that the bearing means need not pass the swivel means, allowing the complete space between the first and the second section to be utilized for building in, while the swivel body may have a robust design. Retention of the swivel body by the bearing means in the second position offers the advantage that the swivel body will not be released from the blocking position unintentionally. In addition, this may yield in a simple manner an even better retention of the first section with respect to the second section. Said retention can of course also be effected by a differently constructed operating part.

In further elaboration of the invention, a telescopic rail according to the invention is characterized as follows.

The use of spring means for biasing the swivel body in the second position during abutment of an operating part, in particular the bearing means, against the swivel body, offers the advantage that the swivel means will in each case be forced into the blocking position and retained therein, which means that, for instance, rattling of the sections relative to each other and/or relative to the blocking means is readily prevented. Thus, an even better, reliable retention is realized. Moreover, the spring means can take up a portion of the force exerted by the first section on the second section upon reaching the extended position, whereby damage and sound nuisance are further prevented, while the extended position will be reached and fixed more fluently. Thus, the content of, for instance, a drawer connected to the telescopic rail is protected as well.

The spring means can, for instance, be formed by a buffer element on the end of the bearing means that leads in extending direction, on a lip or the like or between the swivel body and one of the sections. Also, the spring means may for instance be arranged on the end of the swivel body that faces the bearing means, for instance integrated therewith in the form of a resilient wall that encloses a chamber. The advantage thus achieved is that, in principle, a buffer element on the end of the bearing means that faces the swivel body can be omitted, of course, different spring meanes can also be combined.

In a first preferred embodiment, a telescopic rail according to the invention is characterized as follows.

In such telescopic rail, the swivel body can readily be fitted with its opening on the lip, such that displacement I thereof in the retracting or extending direction of the sections is prevented. The inclined first wall of the opening, which first wall faces the bearing means, offers the advantage that a swivel movement of the swivel body about the fastening means still remains possible. Indeed, the top end of the inclined wall will be moved against the fastening means sooner than the bottom end, so that a swivel movement is automatically effected. In this respect, it is preferred that the stop face, i.e. the face that will be struck by the bearing means upon reaching the second position, be approximately parallel or at least include an angle with the first face, so that the desired swivel movement can readily e fully reached or the swivel body can even be pressed further to ensure a proper blocking. To this end, the angle enclosed is preferably slightly greater than 90°, for instance 93°.

In a further elaboration, a telescopic rail according to the invention is further characterized as follows.

Closing off the opening in the swivel body at least partially, such that the swivel body can be suspended on a relatively long lip, offers the advantage that the position of the swivel body relative to a section to be engaged by the swivel body is determined by the height of the lip, related to the distance between said section and the section on which the lip is provided. This means that the same swivel body can be used for different guides, regardless of the intermediate distance between the different sections.

In further elaboration, a telescopic rail according to the invention is further characterized as follows.

In such embodiment, the advantage achieved is that both the first position and the second position of the swivel body are defined unequivocally, so that a proper control of the swivel body can readily be obtained, while excessive wear of the swivel body is prevented.

In a further advantageous embodiment, a telescopic rail according to the invention is characterized as follows.

As the swivel body projects outside the second section by at least a portion of the blocking part thereof, the advantage achieved is that the operation thereof is possible in a particularly simple manner. Indeed, for instance with a finger, the blocking part can be pressed away in the direction of the first position, until the second section can pass the blocking means. By providing the blocking part with a slightly roof-shaped top end, the advantage achieved is that only a relatively small displacement of the blocking part is necessary before a longitudinal edge of the opening in the second section can engage the relevant inclined face for pressing the swivel body further away. Moreover, this yields the advantage that when, on the side of the second section pointing away from the first section, a third section is coupled to the second section, with intermediate second bearing means, operation of the swivel body is possible through cooperation with a stop lip on the third section or, for instance, said second bearing means, which can initiate the swivel movement of the swivel body from the second position in the direction of the first position. In such embodiment, the situation that, for instance, fingers can get stuck between sections moving with respect to each other is readily prevented.

The invention further relates to a telescopic rail having at least three sections. In a first advantageous embodiment, a telescopic rail having at least three sections according to the invention is characterized as follows.

The use of identical, at least comparable blocking means for blocking the first section relative to the second section and for blocking the first or second section relative to the third section, offers the advantage, in addition to the above-mentioned advantages of the blocking means, that the operation thereof is identical, while the manufacture of the swivel bodies is even more advantageous. Moreover, operation is possible in random order.

In an alternative embodiment, a telescopic rail according to the invention is characterized as follows.

Such embodiment offers the advantage that retention of the third section relative to the adjoining, in particular the second section is obtained by the cooperating projections or backs, which retention can be overcome in a relatively simple manner through elastic deformation of one of the parts, without requiring manual operation of the blocking means. The retaining force can be overcome by pressing in retracting direction against the relevant section with a force greater than a preselected, minimal pressure force. Preferably, the second bearing means are of such design that when the third section is moved further relative to the second section in the direction of the retracted position, the swivel body between the second section and the first section is actuated, in particular moved in the direction of the first position, such that by the third section, the second section can the moved along relative to the first section, in the direction of the retracted position. This simplifies the use of the telescopic rail even further.

In a further alternative embodiment, a telescopic rail according to the invention is characterized as follows.

A spring element biased in the direction of a blocking position offers the advantage that it cannot simply be moved from the blocking position in the direction of the first position by a force in the retracting direction of the telescopic rail, so that unintentional retraction of the telesopic rail can readily be prevented, while operation of the spring element is possible in a simple manner, as this element is, in principle, provided on, or at least adjacent, the leading end of the telescopic rail, while at least a part thereof can be engaged from the outside for pressing it into the first position.

In a further embodiment, a telescopic rail according to the invention is further characterized as follows.

By using the pressure means for moving the spring element at least substantially into the first position and keeping it in the first position, the advantage achieved is that the desired movement can be obtained without the third section having to be moved relative to the second section. This readily prevents a user from getting his fingers stuck between the sections in question. Moreover, this achieves the advantage that when two telescopic rails according to the invention are used for suspending, for instance, a relatively wide drawer, the telescopic rails arranged on either side of the relevant drawer can be released independently of each other, before the drawer is retracted. This simplifies the operation of the drawer considerably, while drawers of a very large width can also be retracted by an individual user.

In a particularly advantageous embodiment, a telescopic rail according to the invention is further characterized as follows.

Such telescopic rail, of the disconnect type, offers the advantage that a drawer or a like element suspended by means of the telescopic rails can simply be removed, together with the third sections.

In a further alternative embodiment, a telescopic rail according to the invention is characterized as follows.

With such a telescopic rail, the advantage achieved is that through retraction of the third section relative to the adjoining section, the blocking means of the second section relative to the first section are operated, such that the complete telescopic rail can be moved into the retracted position. This prevents the necessity of reaching relatively far into the cabinet for releasing the second section relative to the first section. Thus, operation of an at least three-part telescopic rail of the subject type is simplified even further.

The invention further relates to a swivel body for use in a telescopic rail of the subject type.

Further advantageous embodiments of a telescopic rail according to the invention will become apparent to those skilled in the art upon reading and understanding of the following detailed description and the accompanying drawings.

BRIEF DESCRIPTION OF THE SEVERAL VIEWS OF THE DRAWINGS

To specify the invention, a number of exemplary embodiments of a telescopic rail according to the invention will hereinafter be described in more detail, with reference to the accompanying drawings. In these drawings.

DETAILED DESCRIPTION OF THE INVENTION

Figure 1:
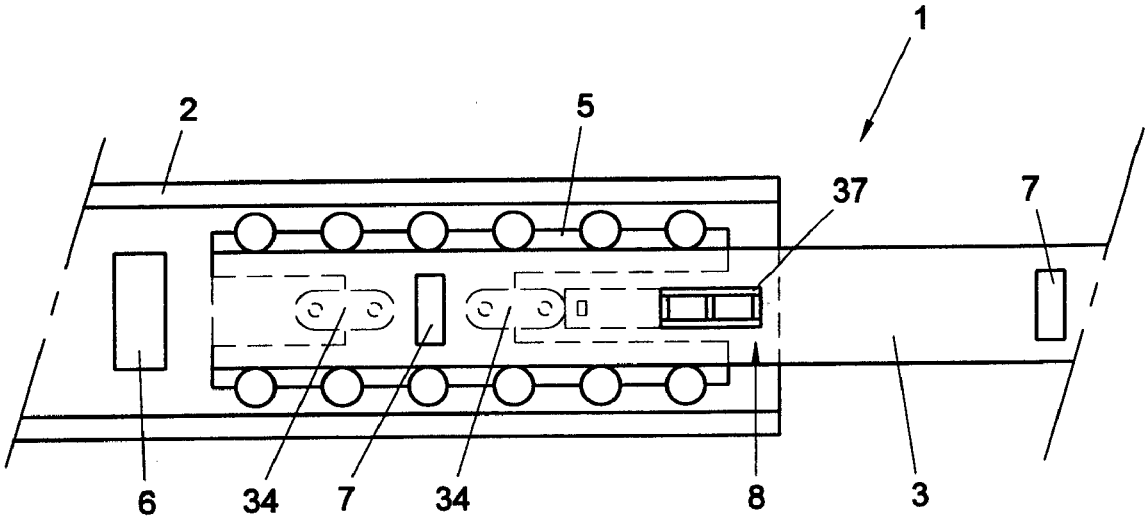
FIG. 1 is a front view of an assembled telescopic rail in a first embodiment.

In the present specification, identical or corresponding parts have identical or corresponding reference numerals. In this specification, a telescopic rail according to the invention is in each case represented as a drawer guide. However, it will be understood that many other applications of a telescopic guide according to the invention are also possible.

Figure 2:
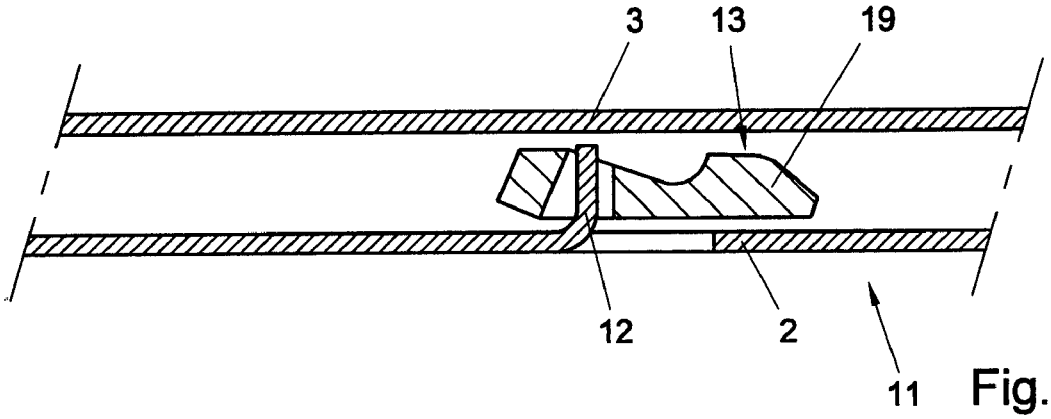
FIG. 2 is a sectional top plan view of a telescopic rail according to FIG. 1, in at least partially retracted condition.
Figure 3:
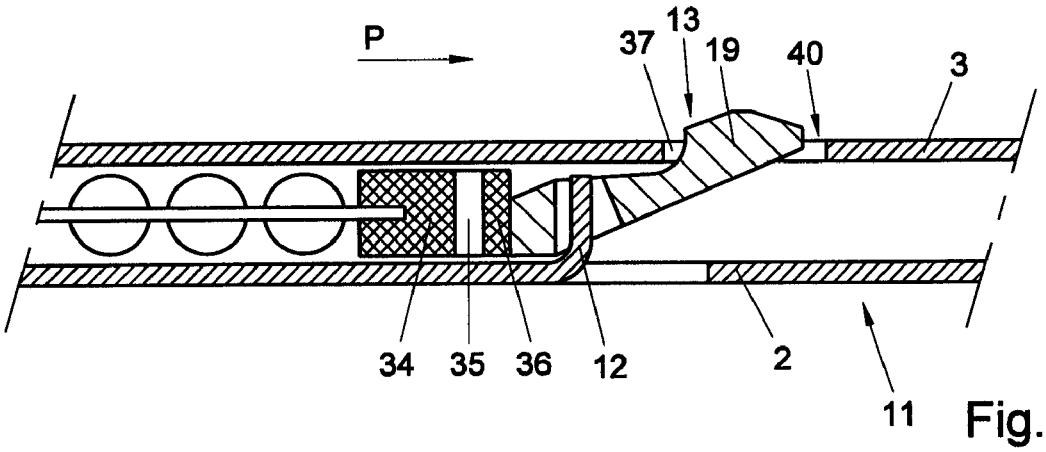
FIG. 3 is a sectional top plan view of a drawer guide according to FIGS. 1 and 2, in blocked, extended condition.

FIGS. 1–3 show a drawer guide 1 according to the invention, comprising a first section 2 to be referred to as cabinet section, and a second section 3 to be referred to as intermediate section. The term "intermediate section" has been chosen in view of, for instance, the three-part or multipart drawer guide shown in FIG. 4, to be described in more detail hereinbelow, in which at least a third section 4 to be referred to as drawer section is provided. In this specification, the or each operating part is primarily shown as part of the bearing means. It will be understood that this may also be designed differently, for instance as a projection or lip or the like, extending in the path of movement of the blocking means.

In the drawer guide 1 shown in FIGS. 1–3, a bearing cage 5 is included between the cabinet section 2 and the intermediate section 3 in a manner known per se, as for instance described in WO 98/03099 and NL 1003665, incorporated herein by reference. Accordingly, the two sections 2 and 3 are slidable relative to each other in the longitudinal direction of the drawer guide. In this embodiment, the cabinet section 2 comprises a number of fastening means 6 with which it can be mounted on, for instance, a cabinet wall, while the intermediate section 3 may comprise, for instance, two brackets 7 with which a drawer or the like can be mounted on the intermediate section 3. There may also be arranged thereon a third, slidable section. The construction of such drawer guides 1 is known per se.

In the condition shown in FIGS. 1 and 3, the drawer guide 1 is fully pulled out and blocked by means of a blocking means 8 to be further described hereinbelow. This blocking offers the advantage that, for instance, a drawer suspended from two such telescopic rails 1 cannot be moved towards a retracted position unintentionally.

Figure 5:
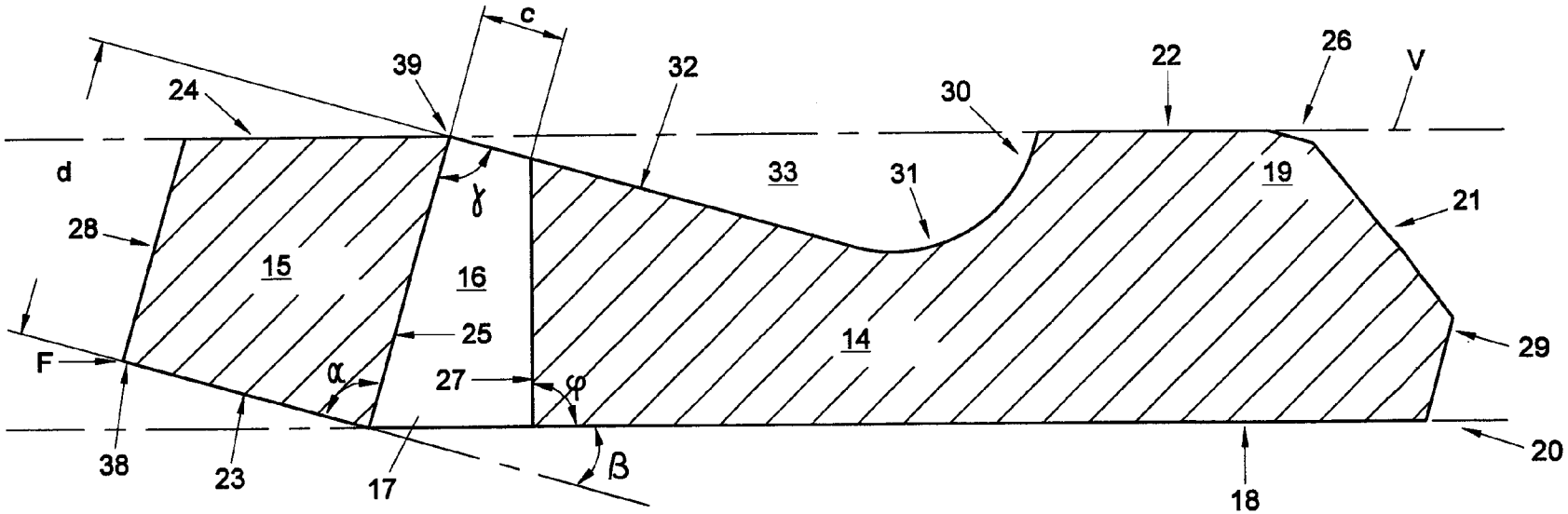
FIG. 5 is a sectional top plan view of a swivel body for use in a telescopic rail according to invention, with cooperating buffer block.

Adjacent a first end 11 which, in practice, leads in the extending direction P, the cabinet section 2 comprises a lip 12 that is bent over inwards, i.e. in the direction of the intermediate section 3. On this lip 12, a swivel body 13 has been slid, such that it is movable between a first position as shown in FIG. 2 and a second position as shown in FIG. 3. The swivel body 13 is shown in more detail in FIG. 5 and comprises a body part 14 and a foot part 15, wherebetween an opening 16 is present. Extending on both sides of the opening 16 is a back 17, which back 17 connects the body part 14 to the foot part 15. The body part 14 has a bottom face 18 connecting to the opening 16. On the opposite side, the body part 14 comprises a blocking part 19, adjacent the end 20 remote from the opening 16. The blocking part 19 comprises a first run-on face 21 connecting to the end 20 and a second run-on face 22 located on the opposite side of the blocking part 19. The run-on faces 21, 22 incline relative to each other and relative to the extending direction P. The purpose of the run-on faces 21, 22 will be explained in more detail hereinbelow.

The foot part 15 comprises a contact face 23 connecting to the opening 16 and the bottom face 18, and a top face 24 located opposite thereto. The opening 16 has a first wall 25, partially forming a boundary of the foot part 15 and connecting to the contact face 23 and the top face 24. The angle α included between the contact face 23 and the first wall 25 is about 90°, preferably slightly greater, for instance 93°. The angle β included between the bottom face 18 and the contact face 23 is acute, for instance between 0 and 40°, in the exemplary embodiment shown about 17°. The top face 24 is approximately parallel to the bottom face 18. The top 26 of the blocking part 19 lies approximately in, or at least not above the plane V in which the top face 24 lies. The height d of the first wall 25 is less than the perpendicular distance between the inner sides of the cabinet section 2 and the intermediate section 3. This means that when the swivel body 3 has its bottom face 18 abutting against the inner side of the cabinet section 2, the intermediate section 3 can move freely over the swivel body.

The opening 16 comprises a second wall 27 located opposite the first wall 25, which second wall 27 includes an angle ϕ with the bottom face 18 that is preferably at least 90°. Adjacent the top end remote from the bottom face 18, the opening 16 has a length c, calculated in the extending direction P, which at least corresponds to the thickness of the lip 12 measured in the same direction, and a width, measured at right angles to the extending direction P, which at least corresponds to the width of the lip 12 measured in the same direction. Hence, the swivel body 13 can be slid with the opening 16 over the lip 12, with the end 20 oriented in the direction of the first end 11 of the cabinet section 2 and with the bottom face 18 facing the cabinet section 2.

The foot part 15 has an end face 28 parallel to the first wall 25. The blocking part 19 has its end 20 provided with a first blocking face 29, parallel to the end face 28 and connecting to the first run-on face 21, which first blocking face 29 extends at right angles to the extending direction P during use. On the opposite side of the blocking part 19, parallel to the first blocking face 29, a second blocking face 30 is provided, connecting to the second run-on face 22. On the side facing the bottom face 18, an abutment face 32 connects to the second blocking face 30 via a curved intermediate face 31 of relatively small radius, which abutment face extends to the top end of the first wall 25 and encloses an angle γ of about 90° therewith. In other words, between the face V on the one hand and the second blocking face 30, intermediate face 31 and abutment face 32 on the other, a slightly bowl-shaped recess 33 is provided. The purpose hereof will be further explained hereinbelow.

On the end of the ball cage 5 that leads in extending direction, a buffer element 34 is provided, having a chamber 35 whose front side is bounded by a resilient wall part 36. Such buffer element 34 is, for instance, known from EU 0 488 471, which publication is understood to be incorporated herein by reference.

Figure 3A:
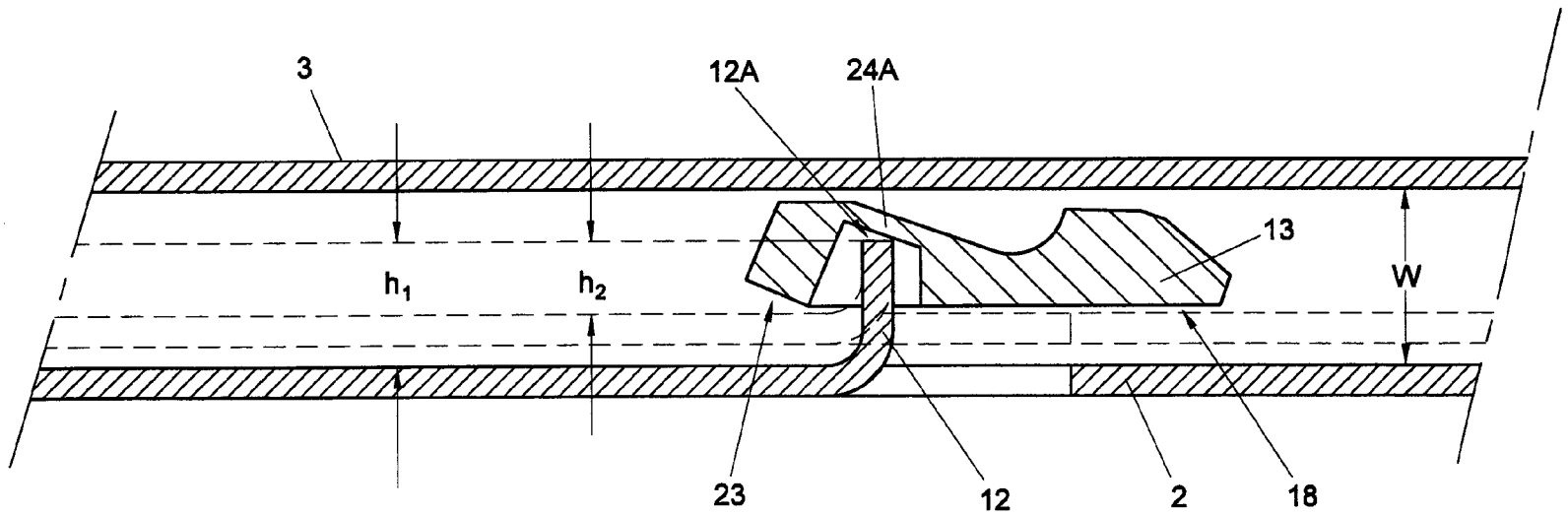
FIG. 3A is a sectional top plan view of a drawer guide according to FIG. 3, in an alternative embodiment.

FIG. 3A is a sectioned view of an alternative embodiment of a swivel body 13, included between sections 2, 3, comparable with FIG. 3. In this embodiment, the opening 16 is at least partially closed off on the side remote from the faces 18, 23 by a closing wall 24A, which, for instance, connects the foot part 15 to the body part 14. When the swivel body 13 is slid with the opening 16 over a lip 12, which lip 12 has a height $h_1$ greater than the depth $h_2$ of the opening 16, the swivel body 13 will have its closing wall 24A bearing on the free end 12A of the lip 12, while the faces 18, 23 of the swivel body 13 will in each case be clear of the section 2 from which the lip 12 is formed. When the height hi of the lip 12 is equal to or less than the depth of the opening 16, the closing wall 24A of said free end 12A will be clear, during at least a portion of the swivel movement of the swivel body 13, while at least one of the faces 18, 23 abuts against the section 2 from which the lip 12 is formed. In such embodiment, the advantage achieved is that a swivel body 13 can be used at different heights h of the lip 12 and at different distances W between the inner sides of the relevant sections 2, 3 without this requiring adaptation of the swivel body 13. After all, the position of the swivel body 13 is substantially determined by the position of the free and 12A of the lip 12 relative to the facing inner side of the section 3. By choosing this distance $(W-h_1)$ to be in each case approximately equal, the same swivel body 13 can in each case be used, regardless of the magnitude of said distance W. A further advantage of such embodiment is that the position of in particular the foot part 15 of the swivel body 13 can in each case be accurately positioned in the path of movement of the relevant operating part. In particular when the bearing means are used as such, this is advantageous, because this may prevent the bearing means from getting stuck between the swivel body and one of the sections 2,3.

During use, the swivel body 13 as shown in FIG. 2 can be entirely included between the two sections 2, 3. If the intermediate section 3 is moved relative to the cabinet section 2 in the extending direction P, the buffer element 34 will, adjacent the extreme position, be moved against the inclined end face 28 by its wall part 36. In this condition, the blocking part 19 is located precisely below a window 37 in the intermediate section 3, which window is shaped and dimensioned such that the blocking part 19 can be received in the window, such that it is filled thereby almost completely. When the intermediate section 3 is moved further in the extending direction P, the swivel body 13 will first be pressed with the top end of the first wall 25 against the lip 12, whereafter, when a force F is being exerted on the bottom edge 38 of the end face 28, the swivel body 13 will subsequently swivel about the top end 39 of the first wall 25, approximately through an angle β. This involves the blocking part 19 being moved into the window 37, with the abutment face 32 being moved towards or possibly against the inner side of the intermediate section 3. The leading edge 40 of the window 37 will lie adjacent or against the first blocking face 29, the trailing edge will lie adjacent or against the second blocking face 30. The force F is exerted by at least the resilient wall part 36, involving elastic deformation thereof. If the intermediate section 3 is released, this will move back slightly, until the leading edge 40 abuts against the first blocking face 29, which prevents any further movement of the intermediate section 3 relative to the cabinet section 2 in the direction opposite to the extending direction P. In this condition, the wall part 36 abuts in still slightly deformed condition against the end wall 28, as a result of which a force will continue to be exerted. Thus, the swivel body is positively forced into the condition shown in FIG. 3, thereby ensuring a positive blocking. This offers the advantage that in a particularly simple manner, even relatively small movements of the sections relative to each other are prevented and sound nuisance is avoided. This moreover prevents the swivel body 13 from falling back unintentionally in the direction of the position shown in FIG. 2, also when the telescopic guide is held with the sections in substantially horizontal condition.

It is preferred that the thickness of the material of the intermediate section and the dimensions of the blocking part 19 be selected such that in the blocking position, the run-on faces 21 and 22 extend at least partially on the side of the intermediate section facing away from the cabinet section 2.

This offers the advantage that the swivel body 13 can in a simple manner be moved back into the first position shown in FIG. 2. After all, for that purpose, the top 26 of the blocking part 19 can be pressed down, for instance with a finger, until the first run-on face 21 has moved at least partially inside the window 37. The leading longitudinal edge 40 of the window 37 can then be moved against the first runon face 21, while further movement of the intermediate section 3 in the direction of the retracted position will provide a further swiveling of the swivel body 13, until it is fully received between the two sections, as shown in FIG. 2. The possibility therefor is partly provided by the fact that the ball cage 5 will move away during such movement of the swivel body 13. As a matter of fact, it will be understood that the above-mentioned first part of the swivel movement of the swivel body 13 from the blocking position may also be initiated in a different manner, for instance by sliding an aid over the outer side, facing away from the cabinet section 2, of the intermediate section 3, against the first run-on face 21, such that it is pressed away inwards. This avoids the risk of a user getting his finger stuck in the window. Also, the swivel body 13 may be provided with a lip or like aid, preferably adjacent its end 20, which lip, when the telescopic rail is in the fully extended condition, partially extends before the first end 11 of the cabinet section 2. In this condition, such lip can then be engaged and pulled slightly in the direction away from the intermediate section 3, thereby swiveling the swivel body 13 slightly in the direction of the first position. Many variations hereto are possible within the framework of the invention. Further, one of the ball cages or like bearing means may be provided with a dent, ridge, rib or the like, which during movement can strike one of the run-on faces 21, 22, for actuation thereof.

Figure 4:
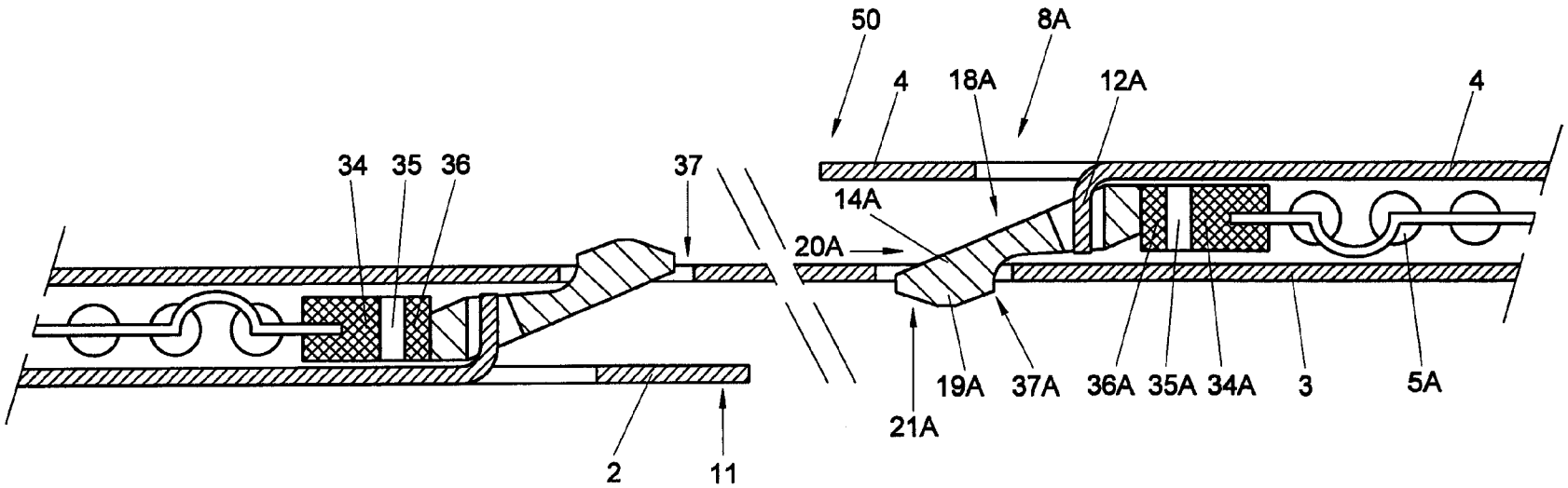
FIG. 4 is a sectional top plan view of a telescopic rail according to the invention, in an alternative embodiment in blocked, extended condition.

FIG. 4 shows a particularly advantageous embodiment of a telescopic rail according to the invention, comprising a cabinet section 2, an intermediate section 3 and a drawer section 4, with intermediate ball cages 5A and 5B respectively. The construction of such three-part telescopic guide is known per se from the above-cited publications. In this embodiment, adjacent the first end 11 of the cabinet section 2, there is included a blocking means 8 as described with reference to FIGS. 1–3. Moreover, the same blocking means 8A is included adjacent the end 50, trailing in extending direction, of the drawer section 4. To that end, the drawer section 4 comprises a lip 12A which extends in the direction of the intermediate section 3 and on which a swivel body 13A is fitted, with the bottom face 18A facing the drawer section 4 and the end 20A being directed towards the end 50 of the drawer section 4. Viewed in extending direction P, a second window 37A is provided in the intermediate section 3 at a distance from the window 37, in which second window the blocking part 19A of the swivel body 13A can be received when the drawer section 4 has been moved into the fully extended position relative to the intermediate section 3, shown in FIG. 4, while the swivel body 13A is forced into and held in the blocking position by a buffer element 34A on the ball cage 5A in a manner described hereinabove.

When the drawer guide is moved from the fully extended and blocked position shown in FIG. 4 to a fully or partially retracted position, the procedure is as follows.

In the above-described manner, the swivel body 13A of the second blocking means 8A is at least slightly pressed from the window 37A by means of a finger or an aid, such that the first run-on face 21A thereof can be moved against the relevant longitudinal edge of the window 37A, whereupon the drawer section 4 can be moved relative to the intermediate section 3 in the direction of the retracted position. This involves the ball cage SA being moved along in the direction of the first blocking means 8. When the drawer guide 4 is being retracted further, the end of the ball cage 5A that leads in retracting direction, or at least the buffer element 34A mounted thereon, will be moved against the first run-on face 21 of the swivel body 13, causing said swivel body 13 to be forced at least slightly in the direction of the first position. Thus, the intermediate section 3 will be released relative to the cabinet section 2 and can be moved further into the retracted position. This renders the operation of the telescopic rails particularly simple and, moreover, at least partially fixes the retracting sequence of the sections. As a matter of fact, the swivel bodies 13, 13A can also be operated in a different manner, for instance in that a fastening lip, stop lip, projection or the like strikes the relevant blocking means, with the above-described effect.

Figure 6:
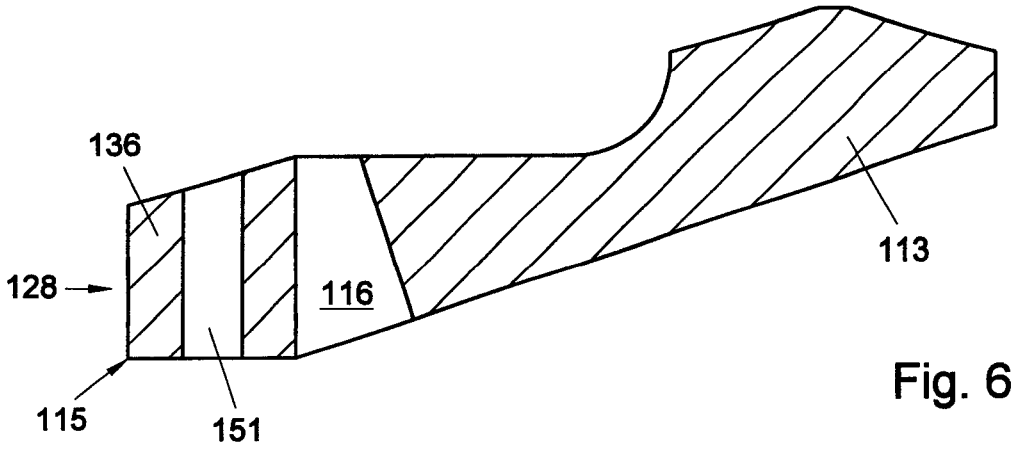
FIG. 6 shows a swivel body according to the invention, in a first alternative embodiment.

FIG. 6 shows an alternative embodiment of a swivel body 113 according to the invention, with a passage 151 provided in the foot part 115, which passage 151 extends next to the opening 116 in such a manner that between the end face 128 and the passage 151, a flexible wall part 136 has been formed. The passage 151 and the flexible wall part 136 together have an action that is identical or at least comparable to that of the chamber 35 and the wall part 36 as described with reference to FIG. 5. The advantage thus achieved is that, in principle, the buffer element 34 as described above can be left out and, for instance, an inwardly bent-over lip of the section moving along the swivel body or the front end of the ball cage 5 can be used as pressure face for actuating the swivel body 113. For that purpose, the front end of the ball cage may or may not be slightly deformed to obtain a raised pressure face. Of course, a swivel body 113 can also be used when the ball cage does in fact have a buffer element. The passage 151 is preferably of such design that the lip 12 cannot be received therein, for instance by giving the passage a relatively small design or by closing it off at the side facing the contact face. Thus, assembling errors of the swivel body are avoided in a simple manner.

Figure 7:
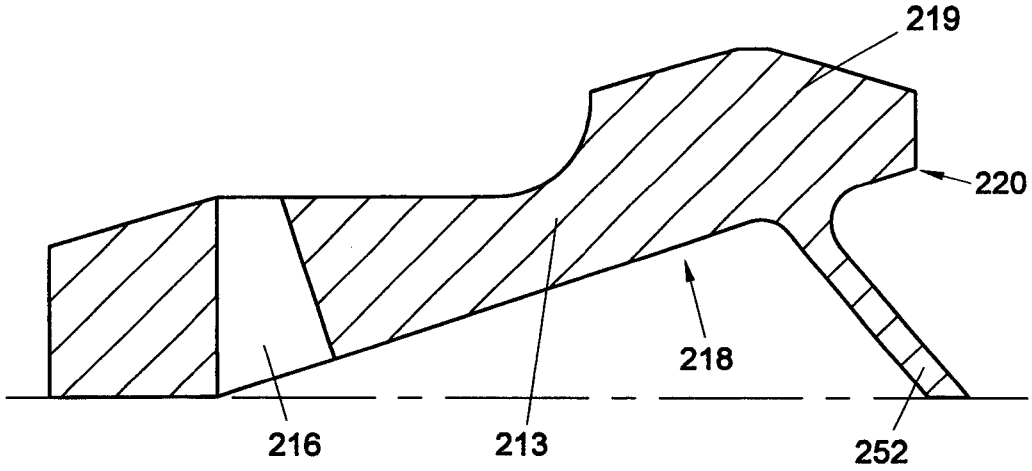
FIG. 7 is a sectional top plan view of a swivel body according to the invention, in a second alternative embodiment.

FIG. 7 shows a further alternative embodiment of a swivel body 213 according to the invention. In this embodiment, the swivel body 213 is provided, adjacent the end 220, with an elastically deformable, flexible leg 252 which extends from the bottom face 218 in the direction away from the opening 216. FIG. 7 shows the swivel body 213 in the blocking position, forced by the leg 252. When the swivel body is pressed in the direction of the first position, the leg 252 will be pressed away, such that it will extend approximately parallel to the bottom face 218. Each time when the relevant window 37, 37A extends above the blocking part 219, the swivel body 213 will be pushed away upwards by the leg 252, causing the blocking part to project in or through the window in the above-described manner. In this embodiment, too, the advantage achieved is that, in principle, the buffer element 34 of the ball cage can be left out. The leg 252 can in each case receive support from the inner side of the relevant section 2, 4.

Figure 8:
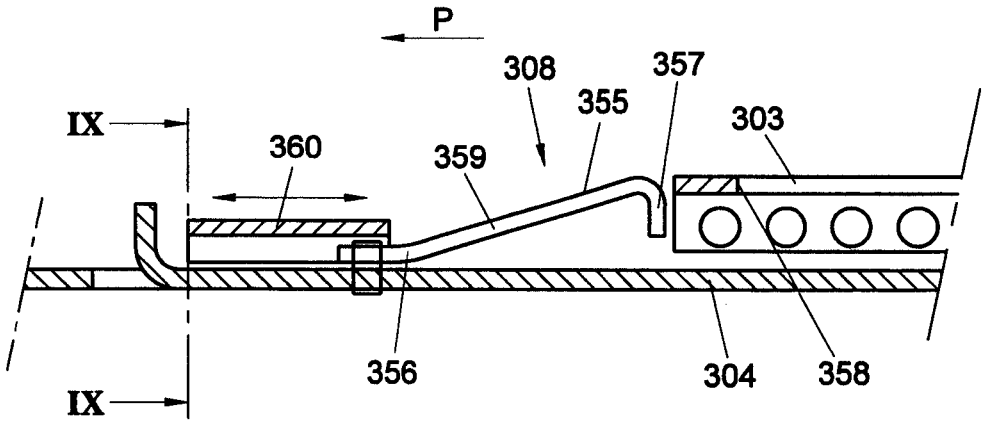
FIG. 8 is a sectional top plan view of a first alternative blocking device according to the invention.
Figure 9:
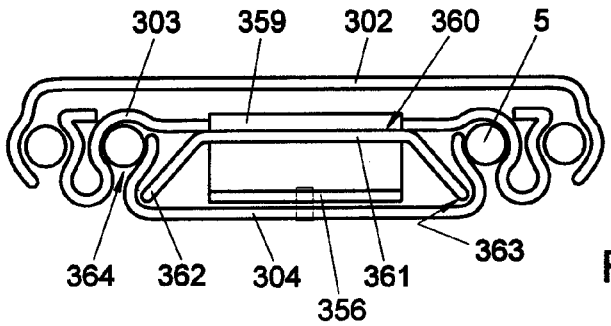
FIG. 9 is a side elevation of a telescopic rail along the reference line IX—IX of FIG. 8.

FIGS. 8 and 9 show an alternative embodiment for blocking means 308, arranged for blocking, for instance, a drawer section 304 relative to an intermediate section 303. The blocking means 308 comprise a leaf spring 355 having a fastening part 356, a first part 359 that is inclined relative to the fastening part, and an end that is bent over relative to the inclined first part 359, which end forms a stop face 357. In a suitable manner, the fastening part 356 is mounted on the side of the drawer section 304 facing the intermediate section 303, for instance by means of pop rivets. The inclined first part 359 inclines in the sliding direction P in the direction of the intermediate section 303, while the end thereof is bent back in the direction of the drawer section 304. FIG. 8 shows the drawer section 304 in the fully pulled-out condition, with the stop face 357 fittingly abutting against the adjoining end 358 of the intermediate section 303.

A sliding piece 360 is included within the drawer section 304 for sliding in the longitudinal direction thereof, which sliding piece 360 has a substantially flat central part 361 and an inclined, outwardly extending edge part 362 on either side thereof. This renders the sliding piece 360 slightly U-shaped. The free edges of the edge part 362 are confined in longitudinal grooves of the drawer section 304, which longitudinal grooves 363 are formed as a result of ball tracks 364 for the ball cage 5 included between the drawer section 304 and the intermediate section 303. This prevents the sliding piece 360 from moving in a direction at right angles to the direction of movement P. The central part 361 of the sliding piece 360 can be slid over the fastening part 356 in the direction of the intermediate section 303, against the inclined first part 359 of the leaf spring 355. If the sliding piece 360 is subsequently pressed on in the direction of the intermediate section 303, the inclined first part 359 of the leaf spring is moved against the inner side of the drawer section 304, such that the intermediate section 303 can be moved over the leaf spring 355 in the retracting direction. The sliding piece 360 is clamped in the drawer section 304 in such a manner that it is not pressed back by the leaf spring 355, so that the leaf spring 355 is held in the pressed-down position. The advantage thus achieved is that when the leaf spring is in the condition shown in FIG. 8, a positive retention of the drawer section relative to the intermediate section is obtained, while the leaf spring 355 for releasing the drawer section need not be touched by the finger of a hand. This prevents fingers from getting stuck between the drawer section and the intermediate section. Moreover, the drawer section 304 can be released in direction of movement relative to the intermediate section 303 without requiring that the drawer section 304 is already moved. This means that, for instance, on either side of a drawer, the drawer section 304 can be released in the above-described manner, before a drawer suspended from the drawer sections is retracted. This is in particular advantageous in the case of relatively wide drawers, at least when there is a relatively large distance between drawer guides to be operated jointly. If so required, the sliding piece 360 can be provided, in particular on the central part 361 thereof, with friction-increasing means, for instance transverse ribs for simplifying the sliding thereof. In the intermediate section 303, means can be provided for pressing the sliding piece 360 back into the starting position when the drawer guide is moved into the fully retracted condition. This renders the leaf spring 355 suitable for use again.

The use of a blocking device as shown in FIGS. 8 and 9 is in particular advantageous when a three-part or multipart telescopic guide of the above-described type is used, while for the further blockings, blocking means as shown in FIGS. 1–7 are applied. After all, after release of the drawer section 304 relative to the intermediate section 303, the retracting operation can thereby be positively initiated with conscious control, whereafter the further blocking means are automatically operated during the retracting operation of the telescopic rail. A sliding piece 360 as shown in FIGS. 8 and 9 can also be applied to other telescopic guides having such a blocking system.

Figure 10A:
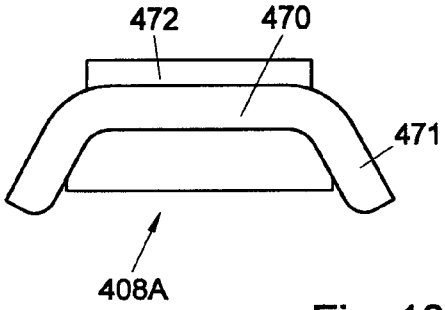
FIGS. 10A and 10B are front views of an alternative blocking means according to the invention, in two embodiments.
Figure 10B:
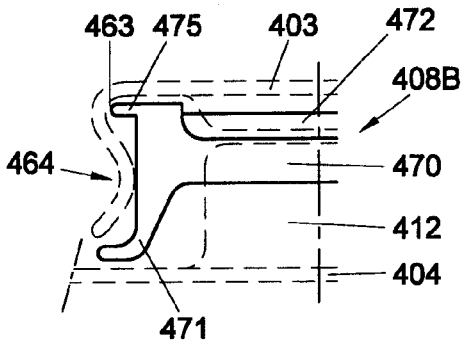
Figure 11:
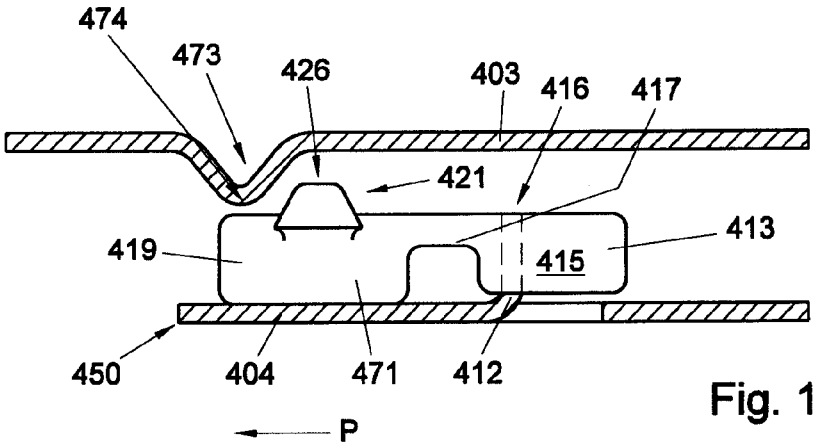
FIG. 11 is a partially sectional top plan view of a portion of a telescopic rail having a blocking means according to FIGS. 10A and 10B.

FIGS. 10A, 10B and 11 show a further embodiment of a blocking means 408A and 408B for use in a telescopic guide according to the invention, retained between, for instance, a drawer section 403 and an intermediate section 404 or cabinet section. For that purpose, the intermediate section 404 (or cabinet section) respectively comprises an inwardly bent lip 412 on which the blocking body 413 can be fitted by means of an opening 416. The blocking body 413 comprises a fastening part 415 accommodating the opening 416, which fastening part 415 is connected to a blocking part 419 via a relatively thin bridge piece 417. The blocking part 419 comprises a central part 470 which, during use, extends approximately parallel to the central part of the intermediate section 404 from which the lip 412 has been bent.

In the embodiment shown in FIGS. 10A and 11, a wing 471 extends on either side of the central part 470, inclining outwards in the direction of the intermediate section 404. In the embodiment shown in FIG. 10B, the wings 471 moreover comprise outwardly inclined support wings 475 that can be received in the longitudinal grooves 463 in the drawer section 403, formed as a result of the ball tracks 464 in the drawer section 403. The blocking body 408A, 408B is manufactured from slightly flexible material, for instance plastic, such that the wings 471 and the support wings 475 are slightly elastically deformable. Provided on the top sides of the blocking part 419, which top side faces the drawer section 403 during use, is a back 472 extending parallel to the central part 470 and at right angles to the extending direction P. This back 472 forms a first blocking part and has a top 426 and, on either side thereof, a run-on face 421. Viewed in extending direction P, the lip 412 is provided adjacent the adjacent end 450 of the intermediate section 404, with the blocking part 419 being oriented in the direction of said end 450. At some distance from the front end, viewed in extending direction, the drawer section 403 is provided with a dent 473 extending inwards, i.e. in the direction of the intermediate section 404, which dent for instance has a slightly elongated shape whose longitudinal direction extends at right angles to the extending direction P. The inner part of the dent 473 extends in the path of movement of the back 472 when the blocking part 419 is undeformed. This means that when the drawer section 403 is being extended relative to the intermediate section 404, the dent 473 will strike the back 472. When the drawer section 403 is moved further in the extending direction, the back 472 will be pressed slightly in the direction of the central part of the intermediate section 404. In the embodiment shown in FIGS. 10A and 11, this will involve elastic deformation of the wings 471, while in the embodiment shown in FIG. 10B, this will also involve some deformation of the central part 470, the arrangement being such that the dent 473, with elastic deformation of a portion of the blocking body 413, can move over the back 472. On the leading side of the dent 473, viewed in extending direction, the back 472 will be pressed back into its original position, causing the drawer section 403 to be blocked in a simple manner in the pulled-out position relative to the intermediate section 404. The embodiment shown in FIG. 10B has the advantage that the distance between the tope side 426 of the back 472 and the facing side of the drawer section 403 is unequivocally fixed, regardless of the distance between the intermediate section 404 and the drawer section 403. Accordingly, the same pressing or pulling force will in each case be required for passing the blocking means 408A and 408B.

In this respect, it is preferred that this concerns the maximally extended position, for instance in that the intermediate ball cage 5A (not shown) has struck a projection or lip or like blocking means provided in a suitable position for that purpose. From the thus blocked, fully extended position, the drawer section 403 can be retracted relative to the intermediate section 404 by exerting on the drawer section 403 a force in the retracting direction, opposite to the extending direction P, such that the deformed material 474 at the dent 473 will again press the back 472 out of its path of movement, with deformation of the wings 471, allowing the back 472 to pass the dent 473 and the blocking part 419 to spring back. Such blocking means 408A and 408B is in particular advantageous when a three-part or multipart telescopic guide is used, while for blocking the other sections, the blocking means described hereinabove with reference of FIGS. 1–7 are used. After all, after the release of the drawer sections 403 relative to the intermediate sections 303, such drawer guides can then be retracted further, while automatically releasing the relevant blockings. In fact, blocking means 408A, 408B as shown in FIGS. 10A, 10B and 11 can also be applied to other telescopic guides.

Figure 12:
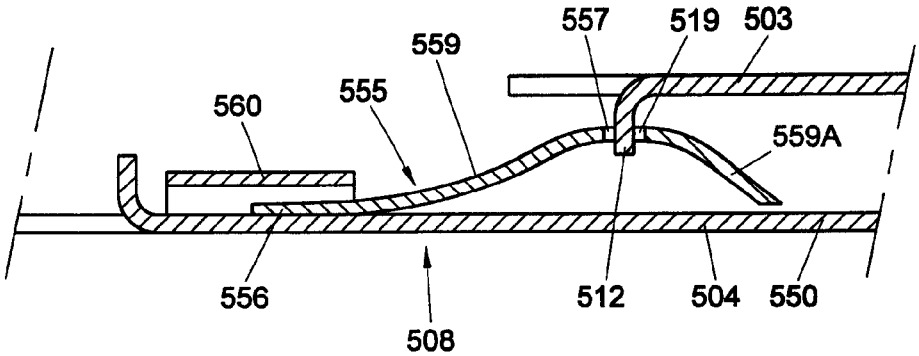
FIG. 12 shows a further alternative embodiment of a telescopic rail according to the invention, having a disconnect-blocking system.

FIG. 12 shows a further alternative embodiment of a blocking means 508 according to the invention, of the disconnect type, wherein a sliding piece 560 is used as described with reference to FIGS. 8 and 9. In this embodiment, a leaf spring is mounted on the inner side of the drawer section 504 by a fastening part 556, which leaf spring comprises a first part 559 which in the retracting direction inclines in the direction of the intermediate section 503 and which has its end remote from the fastening part 556 connecting to a blocking part 519. From the blocking part 519, a second inclined part 559A extends, in retracting direction back in the direction of the rearmost end 550 of the drawer section 504. Provided in the blocking part 519 is an opening 557. In this opening, a lip 512 can be received at least partially, which lip extends adjacent the front end of the intermediate section 503 in the direction of the drawer section 504. In this condition, shown in FIG. 12, the drawer section 504 is blocked with respect to the intermediate section 503 in the retracting direction as well as in the extending direction.

By pressing, in the above-described manner, the leaf spring 555 at least substantially flat against the inner side of the drawer section 504 by means of a finger or, preferably, by means of the sliding piece 560, the opening 557 is moved away from the lip 512, causing the drawer section 504 to be released with respect to the intermediate section 503 in the retracting direction as well as in the extending direction. This means that the drawer section 504 can be completely detached or pressed back into the retracted position. If the drawer section 504 has been detached completely, it can easily be repositioned again, while during retraction of the drawer section, the lip 512 will strike the second inclined part 559A and, when pressed further, flatten the leaf spring 555 such that the lip 512 can again be received in the opening 557 or pass this opening. After the lip 512 has passed the opening 557 in retracting direction, the drawer guide can again be retracted completely, in the above-described manner.

The invention is in no way limited to the exemplary embodiments shown in the specification and Figures. Many variations thereto are possible within the framework of the invention as represented in the claims.

For instance, the sections may be designed and intercoupled differently, for instance one next to or below the other, while, moreover, the swivel direction of the swivel part may be chosen to be different, for instance in a plane parallel to the juxtaposed central parts of the sections, for instance through or along one of the ball tracks of the relevant ball cages. Also, other bearing means may be used, for instance slide bearings. A drawer guide according to the present invention may be used for all types of different applications, for instance for cabinet drawers, computer racks, storage systems for vehicles, displaceable display racks and the like, while the telescopic rail may assume any desired position. After all, the blocking action of blocking means according to the present invention is independent of gravity. Further, blocking means according to the present invention, in particular a swivel body, may be mounted on a relevant section differently and engage an adjacent section differently, for instance behind an end edge thereof or behind a lip, projection or other stop means formed thereon or therein.

What is claimed is:

1. A telescopic rail, comprising:

a first section;

at least a second section with intermediate bearing means, said second section being adjustable with respect to said first section in the longitudinal direction between a retracted and an extend position, while on the first section; and blocking means are provided for blocking the freedom of movement of the second section with respect to the first section, the blocking means including, a swivel body, and at least one operating part extending at least partially between the relevant sections for controlling said swivel body, said swivel body is in a first position included between the first and second sections and can be moved into a second blocking position by each operating part, the swivel body extending, by a blocking part thereof, at least partially through an opening into or behind an edge of the second section;

wherein the swivel body is mounted on the first section, adjacent a first end of the path movement of the bearing means, said bearing means comprising at least one operating part, such that when the sections are in the extended position, the bearing means contact and abut against an abutment face of the swivel body, while during use, the movement of the bearing means against the swivel body brings about a swivel movement thereof towards the second position, about a swivel axis enclosing an angle with the direction of movement of the bearing means, the swivel body being retained in the second position by the bearing means.

2. A telescopic rail according to claim 1, wherein the at least one operating part and/or the swivel body comprise spring means for biasing the swivel body in the second position, at least when the relevant operating part abuts against the abutment face of the swivel body.

3. A telescopic rail according to claim 2, wherein the spring means comprise at least one spring element provided on the at least one operating part and/or adjacent the abutment face, said spring element in the second position of the swivel body being slightly elastically deformed, such that in the direction of the second position, a force is exerted on the swivel body.

4. A telescopic rail according to claim 3, wherein second blocking means are provided.

5. A telescopic rail, comprising:

a first section;

at least a second section with intermediate bearing means, said second section being adjustable with respect to said first section in the longitudinal direction between a retracted and an extend position, while on the first section; and blocking means are provided for blocking the freedom of movement of the second section with respect to the first section, the blocking means including, a swivel body, and at least one operating part extending at least partially between the relevant sections for controlling said swivel body, said swivel body is in a first position included between the first and second sections and can be moved into a second blocking position by each operating part, the swivel body extending, by a blocking part thereof, at least partially through an opening into or behind an edge of the second section;

wherein the swivel body has an opening whereby it can be fitted on fastening means on the first section, while a first wall of the opening, located on a side of the bearing means, is inclined, such that in the first position of the swivel body, said first wall is substantially clear of the fastening means and encloses a first angle therewith, while in the second position, said first wall has moved in the direction of the fastening means, or at least encloses a second angle therewith that is smaller than said first angle.

6. A telescope rail according to claim 5, wherein the swivel body comprises a bottom face which in the first position can at least partially abut against the first section, the first wall of the opening enclosing a first angle with said bottom face, while, further, a contact face is provided which at least partially encloses an angle of about 90°, and slightly greater than 90°, with the first wall and encloses an angle with the bottom face which is approximately equal to said first angle, the arrangement being such that during swiveling from the first position into the second position, the bottom face is released from the first section and the contact face contacts the first section, to bound the angle of swivel, the first wall being moved substantially against the fastening means.

7. Telescopic rail according to claim 5, wherein said fastening means comprises a lip.

8. A telescopic rail according to claim 7, wherein the opening is provided with an at least partially closed intermediate wall or end wall, such that during use, said lip cannot extend outside the opening two-sidedly, while with a relatively long lip, the swivel body can, by its intermediate or end wall, receive support from the lip.

9. A telescopic rail, comprising:

a first section;

at least a second section with intermediate bearing means, said second section being adjustable with respect to said first section in the longitudinal direction between a retracted and an extend position, while on the first section; and blocking means are provided for blocking the freedom of movement of the second section with respect to the first section, the blocking means including, a swivel body, and at least one operating part extending at least partially between the relevant sections for controlling said swivel body, said swivel body is in a first position included between the first and second sections and can be moved into a second blocking position by each operating part, the swivel body extending, by a blocking part thereof, at least partially through an opening into or behind an edge of the second section, wherein the blocking part has a height such that at least a part thereof in the second position of the swivel body extends above the surface of the second section facing away from the first section, the blocking part comprising two top faces that extend from a top and are inclined in opposite directions in the direction of movement of the sections.

10. A telescopic rail, comprising:

a first section;

at least a second section with intermediate bearing means, said second section being adjustable with respect to said first section in the longitudinal direction between a retracted and an extend position, while on the first section;

a third section is provided that is slidable with respect to the first and/or second section in longitudinal direction between a retracted and an extended position, with intermediate second bearing means, while second blocking means are provided between the second and the third section for blocking said sections at least in the extended position; and blocking means are provided for blocking the freedom of movement of the second section with respect to the first section, the blocking means including, a swivel body, and at least one operating part extending at least partially between the relevant sections for controlling said swivel body, said swivel body is in a first position included between the first and second sections and can be moved into a second blocking position by each operating part, the swivel body extending, by a blocking part thereof, at least partially through an opening into or behind an edge of the second section;

wherein the swivel body is mounted on the first section, preferably adjacent a first end of the path movement of the bearing means, said bearing means comprising at least one operating part, such that when the sections are in the extended position, the bearing means contact and abut against an abutment face of the swivel body, while during use, the movement of the bearing means against the swivel body brings about a swivel movement thereof towards the second position, about a swivel axis enclosing an angle with the direction of movement of the bearing means, the swivel body being retained in the second position by the bearing means.

11. A telescopic rail according to claim 10, wherein the second blocking means comprise a second blocking body provided adjacent the leading end, in the extending direction of the third section, of the adjoining section, said second blocking body comprising at least one lip spring-supported by the relevant adjoining section, with a first projection or back being provided on the second blocking body, while on the side of the third section facing the second blocking body there is provided a second projection or back, the first and second projections being positioned in each other's path of movement, while the first projection or back can be temporarily pressed away from the path of movement of the first projection or back through elastic deformation of at least the at least one resilient lip, such that in the fully extended position the second projection or back is retained behind the first projection or back.

12. A telescopic rail according to claim 10, wherein the second blocking means comprise a spring element mounted adjacent the end of a third rail and biased in the direction of the adjoining section, which spring element, during relative movement of the third section with respect to the adjoining section, is receivable in a first position between the relevant adjoining sections and, when reaching the extended position, moves away at least partially from the third section into the second position, causing a portion of the spring element to abut against an edge of the adjoining section and to retain it in said extended position.

13. A telescopic rail according to claim 12, wherein pressure means are provided which, when the third section is in the fully extended position, are placeable over the spring element for bringing it at least substantially into the first position and fixing it temporarily, such that the adjoining section can pass the spring element at least partially, said pressure means being designated for sliding within the third section over a portion of the spring element.

14. A telescopic rail according to claim 10, wherein the second blocking means can be pressed away from a retaining position, such that the relevant third section, beyond the extended position, can be moved further, such that the third section can be fully detached from the adjoining section to form a telescopic rail of the disconnect type.

15. A telescopic rail according to claim 10, wherein the blocking part of the swivel body is movable from the blocking second position in the direction of the first position through a part extending between the second and the third sections, such that the second section can pass the blocking means, while forcing the swivel body further in the direction of the first position.

16. A telescopic rail, comprising:

a first section;

at least a second section with intermediate bearing means, said second section being adjustable with respect to said first section in the longitudinal direction between a retracted and an extend position, while on the first section; and blocking means are provided for blocking the freedom of movement of the second section with respect to the first section, the blocking means including, a swivel body, and at least one operating part extending at least partially between the relevant sections for controlling said swivel body, said swivel body is in a first position included between the first and second sections and can be moved into a second blocking position by the at least one operating part, the swivel body extending, by a blocking part thereof, at least partially through an opening into or behind an edge of the second section;

wherein the swivel body is mounted on the first section, adjacent a first end of the path movement of the bearing means, said bearing means comprising at least one operating part, such that when the sections are in the extended position, the bearing means contact and abut against an abutment face of the swivel body, while during use, the movement of the bearing means against the swivel body brings about a swivel movement thereof towards the second position, about a swivel axis enclosing an angle with the direction of movement of the bearing means, the swivel body being retained in the second position by the bearing means;

wherein the at least one operating part on said swivel body and/or the swivel body comprise spring means for biasing the swivel body in the second position, at least when the at least one operating part abuts against the abutment face of the swivel body;

the spring means comprise at least one spring element provided on the at least one operating part and/or adjacent the abutment face, said spring element in the second position of the swivel body being slightly elastically deformed, such that in the direction of the second position, a force is exerted on the swivel body;

the swivel body has an opening whereby it can be fitted on fastening means on the first section, while a first wall of the opening, located on the side of the bearing means, is inclined, such that in the first position of the swivel body, said first wall is substantially clear of the fastening means and encloses a first angle therewith, while in the second position, said first wall has moved in the direction of the fastening means, or at least encloses a second angle therewith that is smaller than said first angle;

the opening is provided with an at least partially closed intermediate wall or end wall, such that during use, said fastening means cannot extend outside the opening two-sidely, while with a relatively long lip, the swivel body can, by its intermediate or end wall, receive support from the fastening means;

the swivel body comprises a bottom face which in the first position can at least partially abut against the first section, the first wall of the opening enclosing a first angle with said bottom face, while, further, a contact face is provided which at least partially encloses an angle of about 90°, and slightly greater than 90°, with the first wall and encloses an angle with the bottom face which is approximately equal to said first angle, the arrangement being such that during swiveling from the first position into the second position, the bottom face is released from the first section and the contact face contacts the first section, to bound the angle of swivel, the first wall being moved substantially against the fastening means.

17. Telescopic rail according to claim 16, wherein said fastening means comprises a lip.

18. A telescopic rail, comprising:

a first section;

at least a second section with intermediate bearing means, said second section being adjustable with respect to said first section in the longitudinal direction between a retracted and an extend position, while on the first section; and blocking means are provided for blocking the freedom of movement of the second section with respect to the first section, the blocking means including, a swivel body, and at least one operating part extending at least partially between the relevant sections for controlling said swivel body, said swivel body is in a first position included between the first and second sections and can be moved into a second blocking position by the at least one operating part, the swivel body extending, by a blocking part thereof, at least partially through an opening into or behind an edge of the second section;

wherein the swivel body is mounted on the first section, adjacent a first end of the path movement of the bearing means, said bearing means comprising at least one operating part, such that when the sections are in the extended position, the bearing means contact and abut against an abutment face of the swivel body, while during use, the movement of the bearing means against the swivel body brings about a swivel movement thereof towards the second position, about a swivel axis enclosing an angle with the direction of movement of the bearing means, the swivel body being retained in the second position by the bearing means;

wherein the blocking part has a height such that at least a part thereof in the second position of the swivel body extends above the surface of the second section facing away from the first section, the blocking part comprising two top faces that extend from a top and are inclined in opposite directions in the direction of movement of the sections;

a third section is provided that is slidable with respect to the first and/or second section in longitudinal direction between a retracted and an extended position, with intermediate second bearing means, while second blocking means are provided between the second and the third section for blocking said sections at least in the extended position.

19. A telescopic rail, comprising:

a first section;

at least a second section with intermediate bearing means, said second section being adjustable with respect to said first section in the longitudinal direction between a retracted and an extend position, while on the first section; and blocking means are provided for blocking the freedom of movement of the second section with respect to the first section, the blocking means including, a swivel body, and at least one operating part extending at least partially between the relevant sections for controlling said swivel body, said swivel body is in a first position included between the first and second sections and can be moved into a second blocking position by the at least one operating part, the swivel body extending, by a blocking part thereof, at least partially through an opening into or behind an edge of the second section;

wherein the swivel body is mounted on the first section, adjacent a first end of the path movement of the bearing means, said bearing means comprising at least one operating part, such that when the sections are in the extended position, the bearing means contact and abut against an abutment face of the swivel body, while during use, the movement of the bearing means against the swivel body brings about a swivel movement thereof towards the second position, about a swivel axis enclosing an angle with the direction of movement of the bearing means, the swivel body being retained in the second position by the bearing means;

a third section that is slidable with respect to the first and/or second section in longitudinal direction between a retracted and an extended position, with intermediate second bearing means, while second blocking means are provided between the second and the third sections for blocking said sections at least in the extended position, and wherein the second blocking means include, a second blocking body provided adjacent a leading end, in the extending direction of the third section, of the adjoining section, said second blocking body comprising at least one lip spring-supported by the relevant adjoining section, with a first projection or back being provided on the second blocking body, while on the side of the third:section facing the second blocking body, there is provided a second projection or back, the first and second projections being positioned in each other's path of movement, while the first projection or back can be temporarily pressed away from the path of movement of the first projection or back through elastic deformation of at least the at least one resilient lip, such that in the fully extended position the second projection or back is retained behind the first projection or back, and a spring element mounted adjacent an end of a third section and biased in the direction of the adjoining section, which spring element, during relative movement of the third section with respect to the adjoining section, is receivable in a first position between the relevant adjoining sections and, when reaching the extended position, moves away at least partially from the third section into the second position, causing a portion of the spring element to abut against an edge of the adjoining section and to retain it in said extended position;

wherein pressure means are provided which, when the third section is in the fully extended position, are placeable over the spring element for bringing it at least substantially into the first position and fixing it temporarily, such that the adjoining section can pass the spring element at least partially, said pressure means being designed for sliding within the third section over a portion of the spring element;

the second blocking means can be pressed away from a retaining position, such that the third section, beyond the extended position, can be moved further, such that the third section can be fully detached from the adjoining section to form a telescopic rail of the disconnect type.

* * * * *

UNITED STATES PATENT AND TRADEMARK OFFICE

CERTIFICATE OF CORRECTION

PATENT NO. : 6,296,338 B1
DATED : October 2, 2001
INVENTOR(S) : Andreas Petronella Maria Stijns It is certified that error appears in the above-identified patent and that said Letters Patent is hereby corrected as shown below:

Title page, Item [54] and Column 1, line 1,
Title, "BAIL" should read -- RAIL --;

Column 2,
Line 31, "the a sections" should read -- the sections --;

Column 3,
Line 15, "displacement I" should read -- displacement --;
Line 27, "readily e fully" should read -- readily be fully --;

Column 6,
Line 16, ""intermediate section"" should read -- "intermediate section 3" --;

Column 7,
Line 66, "hi" should read -- $h_1$ --; and

Column 10,
Line 1, "SA" should read -- 5A --.

Signed and Sealed this

Twenty-second Day of November, 2005

JON W. DUDAS
*Director of the United States Patent and Trademark Office*